United States Patent [19]

Termet

[11] 4,134,527

[45] Jan. 16, 1979

[54] POWDER CHARGE OPERATED APPARATUS

[75] Inventor: Pierre Termet, Lyon, France

[73] Assignee: Societe de Prospection et d'Inventions Techniques Spit, Bourg-les-Valence, France

[21] Appl. No.: 792,605

[22] Filed: May 2, 1977

[30] Foreign Application Priority Data

May 6, 1976 [FR] France ..... 76 13552

[51] Int. Cl.[2] ..... B25C 1/14

[52] U.S. Cl. ..... 227/10

[58] Field of Search ..... 227/8, 9, 10, 11

[56] References Cited

U.S. PATENT DOCUMENTS

| | | | |
|---|---|---|---|
| 3,115,637 | 12/1963 | Elliott | 227/10 |
| 3,348,751 | 10/1967 | Henning | 227/8 |
| 3,915,242 | 10/1975 | Bell | 227/10 |
| 3,918,619 | 11/1975 | Termet | 227/8 |

*Primary Examiner*—Granville Y. Custer, Jr.
*Attorney, Agent, or Firm*—Brisebois & Kruger

[57] ABSTRACT

A fastener driving gun with a driving piston actuated by a cartridge to drive a fastener. The piston has an elongated shank with a tapered surface which engages a cooperating surface of the barrel, in the forward position of the piston, to prevent ejection of any substantial portion of the piston in the event of piston breakage. The taper of the piston can be 3% or less.

2 Claims, 6 Drawing Figures

POWDER CHARGE OPERATED APPARATUS

This invention deals with an apparatus activated by a powder charge such as a fastening apparatus using nails or pegs, or fastening equipment or any type of apparatus where propulsion is provided by a powder charge within a gun for an intermediate part called a plunger or ram which propels or hits a part such as a sealing pin.

There already exist several similar items of equipment consisting of weights or rams of varying weights and propulsion speeds.

The weak point in this type of apparatus is, as a rule, the ram which is the part subject to the greatest stress and which bears high impact and compression loads. After a while, this gives rise to major danger of the part fracturing. These fractures call for the replacement of the ram by a new part and this is relatively costly and maintains the equipment out of service for some time.

Moreover, the fracture may be dangerous and at least part of the ram may be ejected from the gun and may cause accidents.

It is the intention of this invention to remedy these drawbacks and to provide equipment of this type where, should a fracture occur, dangerous ejection of part of the ram is avoided.

The invention also intends to cover manufacture of strengthened ram equipment considerably reducing the risk of a fracture. It also proposes an embodiment where the ram is automatically withdrawn to its firing position.

Further, the invention will also cover the manufacture of equipment improving the means of driving home sealing components such as pegs or nails.

This invention covers a powder-activated apparatus such as bolting or sealing equipment consisting of a handle incorporating the trigger mechanism, a powder combustion chamber which communicates with a barrel within which a ram travels from back to front characterized by the fact that said ram has a rear head propelled by the gas thrust provided by the explosion and a forward shaft, said barrel more particularly having at one end a stop surface which may work in conjunction with a complementary stop located at the forward end of the shaft to stop it at end of travel especially in the event of a fracture.

In one form of particularly preferred embodiment the ram shaft, which follows the rear head of the same ram, is in the form of a truncated cone over a considerable section of its length. Of particular interest is the forward section of the shaft having this truncated conical form and the forward section of the barrel having a complementary truncated conical form enabling it to stop the forward truncated conical section of the shaft.

This shaft should preferably be of trancated conical shape over its entire length but it may incorporate one or more cylindrical sections combined with one or more truncated conical sections.

A further advantage consists in the possibility of connecting the shaft by means of a connecting section which follows a marked parabola.

The conicity of the shaft is small and preferably below 3%.

In another embodiment, a short truncated conical bearing surface for the forward barrel stop cooperates with an equally short truncated conical section located near the front end of the ram. Alternative stopping means may be used such as a radial stud located towards the front end of the barrel and slightly penetrating into the barrel to come up against the shoulder located on the front section of the ram head.

Further advantages may be obtained by using means to ensure that, once it has been fired, the ram is withdrawn to its rear position and for this purpose it is preferable to use an elastomer shock absorber coming into contact with a conical section of the ram shaft and also, preferably, with the parabolic connector if used in such a way that the shock absorber is compressed when the ram comes to its end position, and it expands and propels the ram backwards to its firing position.

A further advantage consists of providing in this case vents or pressure equalizing devices enabling the ram to be returned by the shock-absorber to its extreme rear position without braking from air being compressed behind the head.

A further advantage includes means to maintain the ram in its rear position until the next firing after it has been returned to its firing position and this may, for example, consist of a slightly conical section at the rear of the barrel which is held by a similar truncated conical section on the ram head.

Further advantages and characteristics of the invention will become clear upon reading the following description which is provided as an example and which is not exhaustive and which should be read with reference to the appended drawings where:

Figure 1:
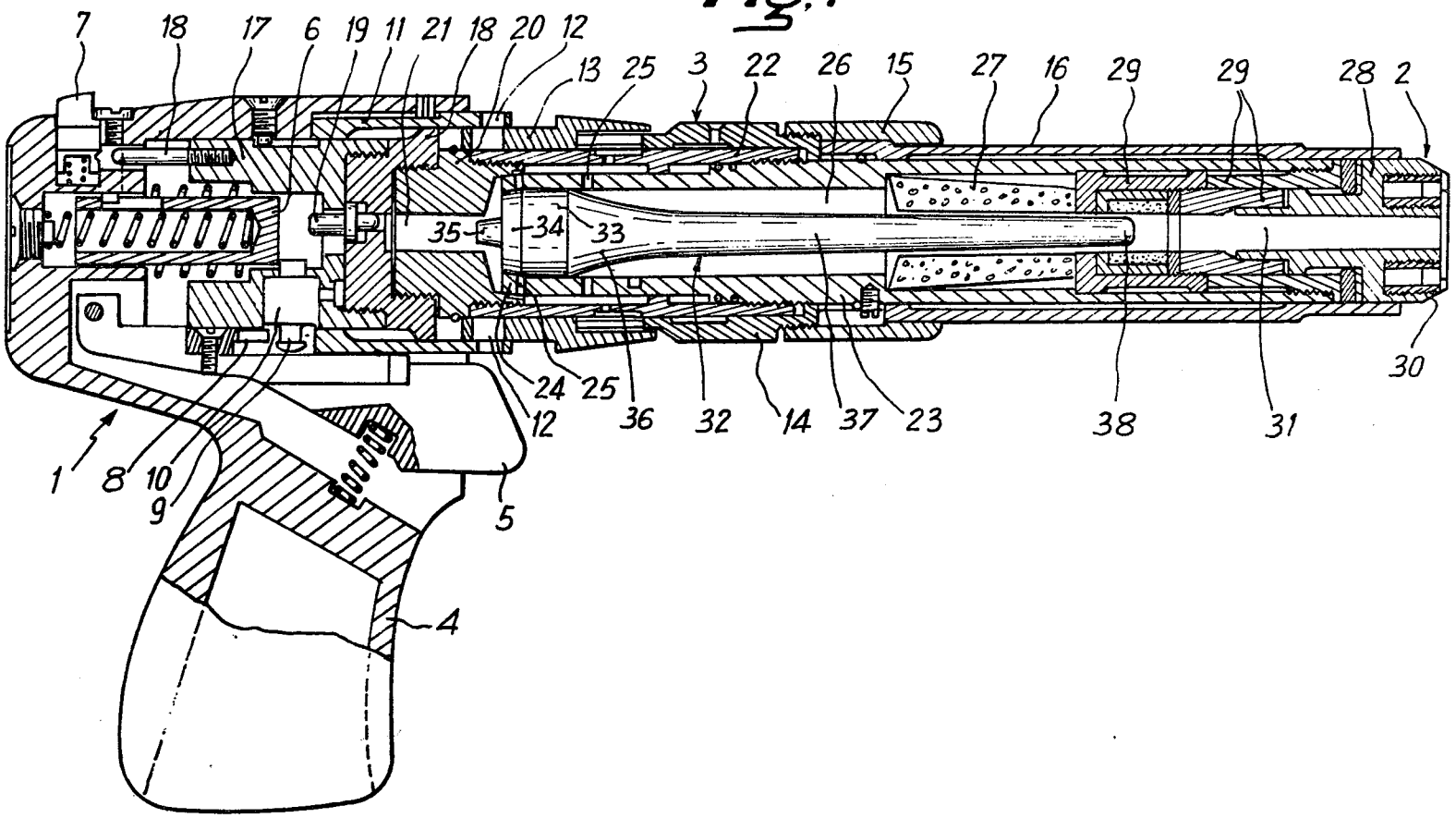
FIG. 1 shows a view in axial section of the apparatus according to the invention.

The apparatus shown in FIG. 1 is a fastener driving gun comprising a handle-firing mechanism assembly 1, a barrel-sliding firing chamber assembly 2 and a casing 3 containing the sliding assembly 2 which, in a well-known manner, permits separation from handle 1 to enable the chamber to be reloaded.

The handle-mechanism 1 assembly comprises the handle 4 itself, a hinged trigger 5 and pushed by a spring, a striking hammer 6 which is then pushed forward by an inner spring, a safety device 7 of any well-known type and, on the trigger 5, a small fork-shaped component 8 which may come into contact with stud 9 when it is moved backwards.

As can be seen, stud 9 forms part of the sliding component 10 whose upper surface prevents hammer 6 being propelled forwards by its spring.

Casing 3 comprises a sleeve 11 held within assembly 1 and having a vertical pivotal axis formed of two pivots 12 which go through a second sleeve 13, followed by a ring 14 to the front of which is threaded a nut 15 and to which is connected an elongated tubular component 16 by nut 15.

Sliding assembly 2 comprises, from back to front, a rear part 17 with extension 18 which cooperates with safety device 7 in a way already known, the part 10 is fitted in such a way that it slides within the lower portion of part 17. Part 17 is connected to a breech 18 which is spherical in shape and which has a firing pin 19 which can be activated by hammer 6. To the front end of breech 18 is located a part 20 which forms the firing chamber 21 to the rear of which is screwed bush 22 within which is located the gun barrel 23 with which it is fixed. As can be seen, the barrel has a slightly conical rear section 24 which becomes narrower towards the rear at the location of part 20, and vents 25 situated further forward. Moreover, it can be seen that the barrel can be brought closer to part 20 by rotating it in the thread of part 22 and thereby adjusting the power of the device.

The barrel 23 has an inner bore 26 which starts off as a large diameter cylinder and which is extended by a well containing the elastomer shock-absorber 27 which has more or less the shape of a sleeve. At the front end of the barrel is an end-fitting 28 which is connected to various components making up assembly 29 and a section of which protrudes beyond part 16, and presents a chamferred end 30. Bore 26 is extended into endfitting 28 by means of bore 31 which has a smaller diameter and which slightly resembles a truncated cone which tapers to one end.

It should be understood that having triggered the safety device, pressure is brought to bear on the front surface of end-fitting 30, and the entire sliding assembly slides backwards within the casing.

The magnitude of this movement depends especially on the angle at which the device is applied against the wall which is to receive the pin. It should specially be noted that if the device is applied perpendicularly to this wall, sleeve 28 may be fully pushed back inside casing part 16. If, on the other hand, the angle between the device and the walls perpendicular axis exceeds the upper limit of the firing angle selected for reasons of safety, end-fitting 28 will not be completely pushed back into casing 16 which is bearing on the wall, and slider assembly 2 will be prevented from sliding to its full extent and will prevent firing from taking place. At the end of one complete sliding movement, stud 9 will have become engaged within the teeth of the fork of part 8 and it will then be possible by pressing trigger 5 to slide part 10 downwards thus freeing hammer 6 and causing percussion and explosion.

A ram 32 is free to move inside the bore of the barrel and it has a large diameter head 33 to the rear of which is a truncated conical chamfer 34 corresponding to the truncated conical bearing surface at end 24 of the barrel. Moreover, head 33 is extended to the rear by a small diameter section 35 which also has the form of a truncated cone and which allows some channeling of gases and partial blocking of chamber 21. Head 33 is extended by a connecting section 36 which has a parabolic taper and which, without breaking continuity, is extended by a slightly conical shaft 37 whose diameter lessens towards end 38.

It should be understood that, at the time of firing, the ram 32 is propelled towards the front and is centered, to its rear by section 26 of the bore and by moving its forward section into bore section 31.

Figure 2:
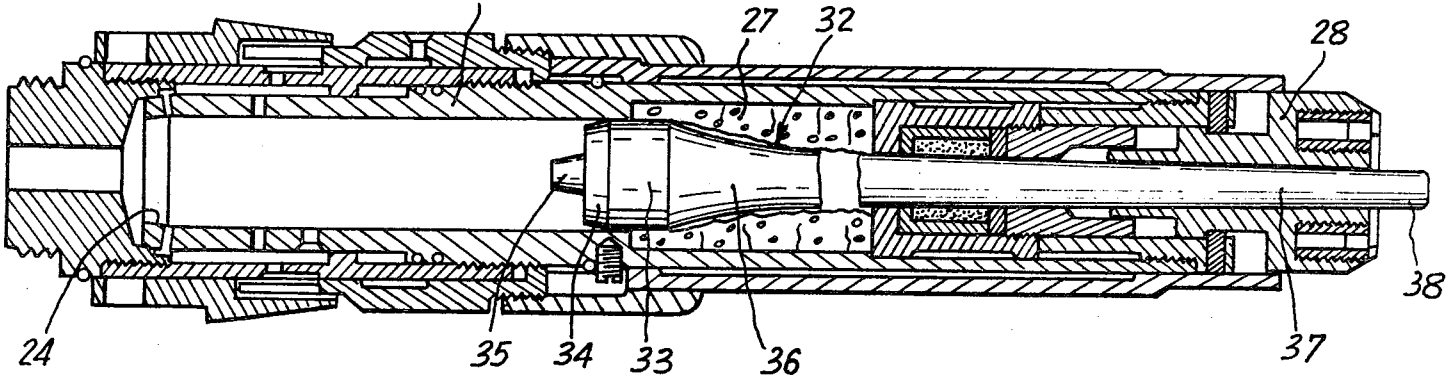
FIG. 2 shows a view of the front portion of the same apparatus with the ram in its forward position.

FIG. 2 shows the extreme end position of ram 32 and it can be seen that, in this position, end 38 protrudes slightly beyond end-fitting 28. It can be seen, moreover, that the surface of shaft 37 comes into contact with the surface of bore 31 which is also in the form of a truncated cone and tapers to the front, in such a way that it is impossible for the ram to be ejected especially in the event of a fracture of the ram. Moreover, head 33 and the parabolic connecting section 36 have buried themselves in shock-absorber sleeve 27 which is shifted and compressed as shown in FIG. 2. It can be seen that at the end of the firing operation, shock-absorber sleeve 27, by expanding, acts on the parabolic surface 36 and on the conical shaft 37, thereby pushing the ram 32 backwards. The ram 32 having been thus pushed back, its conical chamfer 34 comes into contact with the conical boss 34 at the end of the barrel 23, and the head 32 remains fixed in the rear position because of the slight angle of this cone (see FIG. 1). The bore of the shock absorber shown in the drawing is tapered, but it is clear that it could also be cylindrical for engaging a corresponding cylindrical surface on the driving piston.

It can, moreover, be seen that if there is a fracture of the ram, the shaft 37 remains wedged in the device since it is held by the conical interior surface of the bore section 31. It cannot therefore escape and fly out of the device together with the pin, in contrast to current devices in which the ram shafts may be ejected from the device if a fracture occurs, and may cause wounds because of their kinetic energy.

Moreover, in the invention the ram shows, surprising, a resistance and a useful life far superior to those of existing devices.

As a matter of fact, upon the driving of fasteners into a support material, pressure forces are exerted either by the fasteners on the forward end 38 of the driving piston, when the support material is very hard, or by the shock absorber on the head portion 33 of the piston, when the support material is a soft material. In the standard design the same ram is made to work alternately in two preset manners, thereby provoking alternating effects at this level of the metal fibers. This makes fracture more likely. Experience has shown that the conical shape of the ram stem enables resistance to be increased significantly. This resistance becomes still more marked given a noticeably parabolic connection between the shaft and the head.

Figure 3:
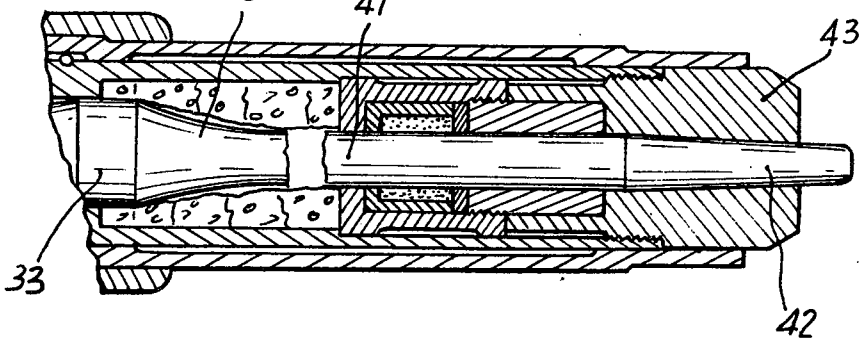
FIG. 3 shows a view of the front portion of an apparatus according to one variation of the invention.

Referring to FIG. 3 we see a variant of the invention in which the stem of the ram presents a cylindrical section 41 tapering to meet the section 36 and terminating in a relatively long conical section 42 and working with the conical interior surface of an orifice traversing an end-fitting 43 similar in use to the end-fitting 28.

Figure 4:
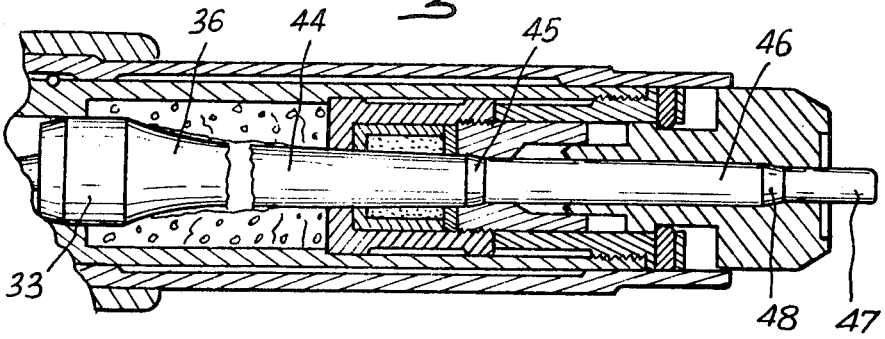
FIG. 4 shows a view of the apparatus according to another variation of the invention.

If however we refer to FIG. 4 we see another variant of the invention in which the section 36 is prolonged firstly by a conical section 44 which is itself joined by a smaller, more sharply conical section 45 to a cylindrical section 46 separated by a new short conical section 48 from a cylindrical end 47 of the ram. Here again the series of sections is of adequate length to obtain the properties of safety, resistance and supply guidance for an element such as a pin or stud.

Figure 5:
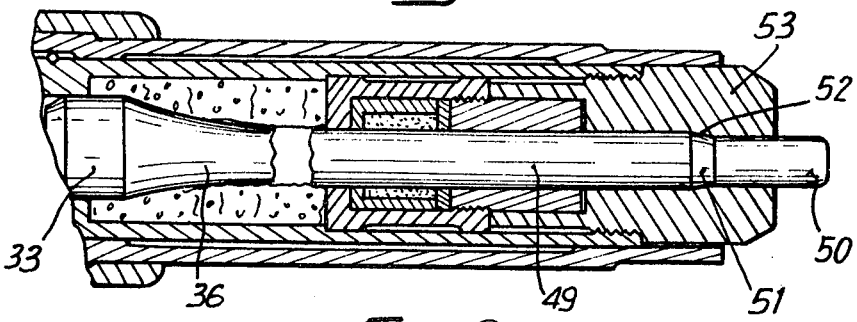
FIG. 5 shows a view in axial section of the front portion of an apparatus according to another variation of the invention.

Referring to FIG. 5 we see a different design in which the ram has as always a head 33 with a parabolic connector 36. In contrast the stem 49 of the ram has a lengthened cylindrical shape joined to a short front cylindrical section 50, having a smaller diameter, by a short conical thrust area 51. This thrust area works with a similar conical area 52 of the bore of the end-fitting 53 of the barrel. Thus, if the ram fractures, only a small section of the ram at most, corresponding to the end 50, may become separated from the device and the probability of this is slight since in this method of construction the most common fractures occur at the level of the stem 49 itself.

Figure 6:
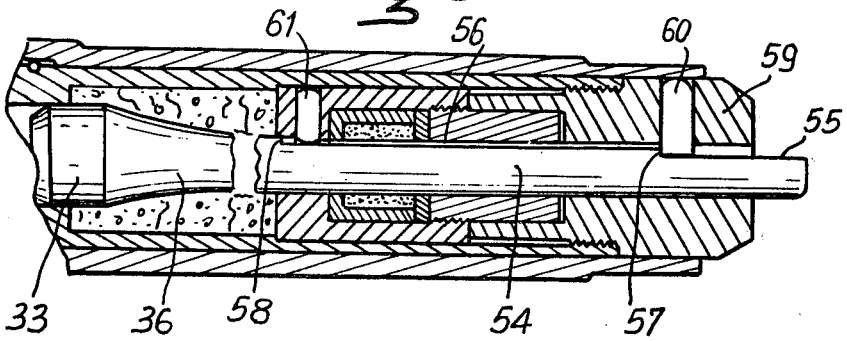
FIG. 6 shows a similar view of an apparatus according to another variation.

Referring to FIG. 6 we see another variant of this second design type in which the ram has a stem 54 which is generally cylindrical along its length and of constant diameter. The stem has, however, a relatively short flattening 55 towards its end and then a second longer flattening 56 which is less marked. A radial shoulder 57 is set between the flattenings 55 and 56 while flattening 56 terminates at its rear end in a radial shoulder 58.

The end-fitting 59 of the barrel of the device consists of a cylindrical radial piece 60 set in a suitable opening of the end-fitting 59 and protruding slightly beyond the interior of the barrel so as to form a thrust area for the shoulder 57 when the ram 54 is pushed into its forward position. There is also a second cylindrical radial piece 61 of smaller dimensions provided inside the barrel for engaging the rear shoulder 58 and also preventing the driving piston from rotating. The distance between the pieces 60 and 61 is however less than the distance between the shoulders 57 and 58 so that the shoulder 58 normally never comes into contact with the piece 61. However, if there is a fracture at the level of the piece 60 of the ram continues its travel at a slower speed and is halted by the thrust of the surface 58 against the projecting section of piece 61.

Although the invention has been described in respect of a particular design form, it is clear that it is in no way limited to this and that various modifications can be made to it without leaving either its basis or the idea behind it.

I claim:

1. A cartridge-actuated fastener driving tool including:

a slidable assembly comprising a barrel, a muzzle at one end of said barrel, a cartridge chamber at the other end of said barrel, and a breech-block and percussion means for exploding a cartridge located at the end of said chamber remote from said barrel, a driving piston slidably mounted in said slidable assembly for actuation by the gases produced by an explosion in said cartridge chamber to eject a fastener from said muzzle, and a tubular casing, within which said slidable assembly is mounted for axial sliding movement, and having a handle with a trigger mounted on the casing near one end thereof, said driving piston comprising a head portion and a shank portion, said shank portion having at least at its forward end a frusto-conical abutting surface formed thereon for engaging a corresponding frusto-conical abutting surface formed on said slidable assembly for retaining a substantial part of said driving piston therein in case of breakage of said piston, said frusto-conical surfaces having a conicity of less than 3%.

2. A cartridge-actuated fastener driving tool according to claim 1, wherein said frusto-conical abutting surface of said shank portion extends over a substantial part of its length.

* * * * *